US005183331A

United States Patent [19]

Edgell et al.

[11] Patent Number: 5,183,331

[45] Date of Patent: Feb. 2, 1993

[54] CANTILEVERED SPOKE MOUNTING FOR LIGHTING FIXTURE

[75] Inventors: James E. Edgell, Roanoke; David L. Jordan, Boones Mill, both of Va.

[73] Assignee: Hubbell Incorporated, Orange, Conn.

[21] Appl. No.: 725,485

[22] Filed: Jul. 3, 1991

[51] Int. Cl.[5] ..... F21M 3/18

[52] U.S. Cl. ..... 362/426; 362/427; 362/431; 362/267; 362/287

[58] Field of Search ..... 362/413, 414, 418, 427, 362/431, 287, 267, 426

[56] References Cited

U.S. PATENT DOCUMENTS

| | | | |
|---|---|---|---|
| 1,270,940 | 7/1918 | Godley | 362/426 |
| 1,283,480 | 11/1918 | Duffy . | |
| 1,301,994 | 4/1919 | Archer et al. . | |
| 1,389,013 | 8/1921 | Schwartz . | |
| 2,107,906 | 2/1938 | Rogers | 240/41 |
| 2,307,977 | 1/1943 | Wellman | 362/414 |
| 2,967,230 | 1/1961 | Goetz et al. | 240/3 |
| 3,246,135 | 4/1966 | Husby | 240/3 |
| 3,519,811 | 7/1970 | Jacobs | 240/3 |
| 4,349,865 | 9/1982 | Terrel | 362/250 |
| 4,380,792 | 4/1983 | Terrell | 362/250 |
| 4,517,632 | 5/1985 | Roos | 362/389 |
| 4,701,833 | 10/1987 | Bornhorst | 362/426 |
| 4,722,502 | 2/1988 | Mueller et al. | 248/284 |
| 4,782,435 | 11/1988 | Manzoni | 362/427 |
| 4,785,190 | 11/1988 | Frankena | 250/503.1 |
| 4,811,923 | 3/1989 | Haberthur | 248/278 |

FOREIGN PATENT DOCUMENTS 2618564 11/1977 Fed. Rep. of Germany .

*Primary Examiner*—Ira S. Lazarus
*Assistant Examiner*—L. Heyman
*Attorney, Agent, or Firm*—Jerry M. Presson; Mark S. Bicks; Alfred N. Goodman

[57] ABSTRACT

An adjustable mounting assembly, for rotatably coupling a support member with electrical wiring to a lighting fixture housing, has at least one casing with a fastening sleeve for receiving a fastener. The casing also has at least one conduit for receiving the support member and the electrical wiring. A spacer is located between the casing and housing and has a bore for the fastener and an aperture for the wiring. The casing is rotatable with respect to the housing and can be releasably retained in selected rotational positions by the fastener.

29 Claims, 7 Drawing Sheets

FIG.3a
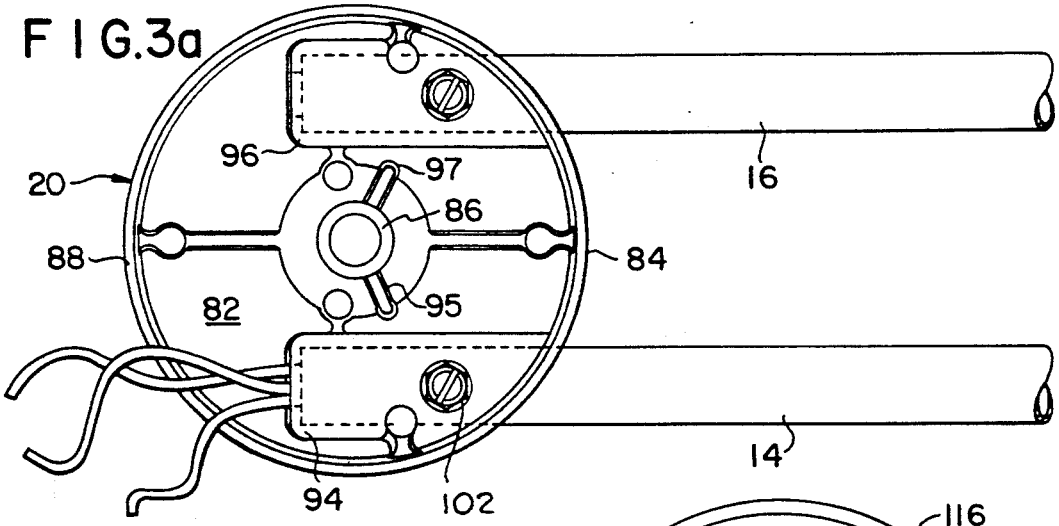
FIG.3b
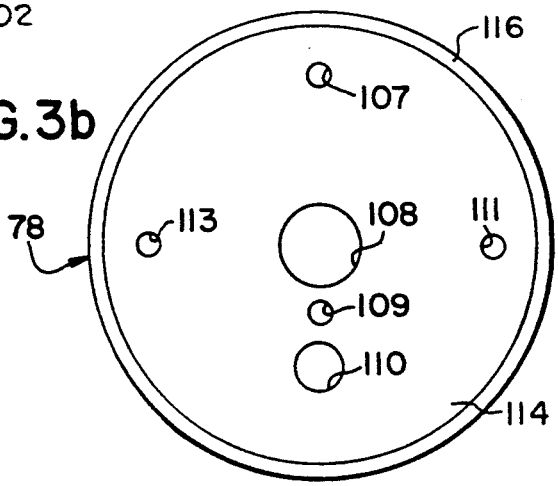
FIG.3d
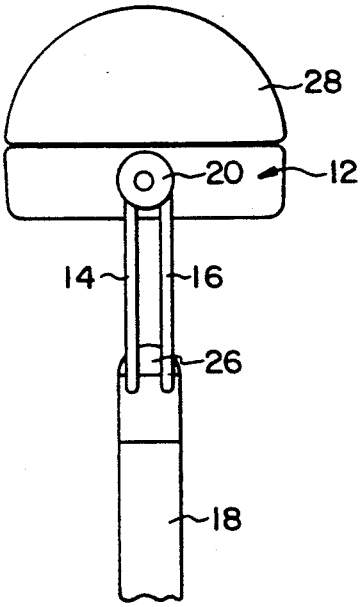
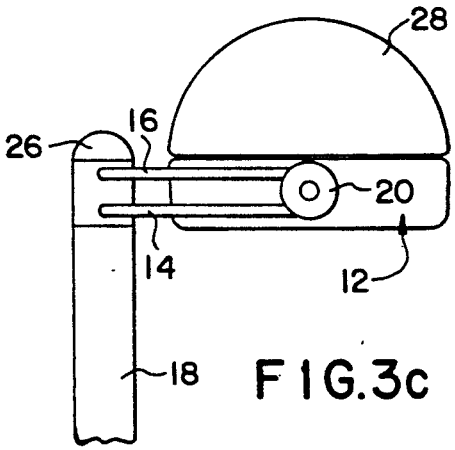
FIG.3c

CANTILEVERED SPOKE MOUNTING FOR LIGHTING FIXTURE

BACKGROUND OF THE INVENTION

Rotatable lamps are typically supported by cantilevered spokes or support arms, often by a pair of opposed cantilevered arms. The adjustable ability of the rotatable lamps facilitates aiming illumination in different directions and servicing the lamp fixture.

However, rotatable lighting fixtures are inherently difficult to connect to a power source. Typical lamp fixtures are connected to electrical wiring at a location separate from the rotating joints to prevent the wiring from becoming frayed or cut by the joint mechanism. However, separating the wiring location and the pivotal joint limits the range of movement of the rotatable lamp to the length of exposed wire, and the exposed wire can deteriorate due to exposure to the environment. If surplus wire is left exposed between the lamp and the supports, it may become tangled from successive rotations. In addition, exposed wiring is often unsightly.

Typical lighting fixtures attempting to overcome the exposed wiring problem provide passage for the wires directly through the rotating joint. In support systems for cantilevered lamps having two support arms, the wiring often extends through one arm of the support, while the opposed arm carries an adjustable fastener, such as a threaded bolt. For lamps which carry the wiring and an adjustable fastener in the same joint, a hollow threaded bushing is often used for the dual purpose of adjustably fastening the support and housing together and providing interior passage for the electrical wiring. However, a hollow bushing has limited strength and may collapse. Further, it is difficult to thread the wiring through the small bushing into the housing, especially in large outdoor lamps. Often, it is desirable to provide adjustable fasteners on both arms of a cantilever support when the lamp housing is large and heavy to ensure a stable and secure lighting assembly.

Examples of unsightly exterior wiring on rotatable lamps are disclosed in U.S. Pat. No. 3,519,811 to Jacobs and U.S. Pat. No. 3,246,135 to Husby. U.S. Pat. No. 1,301,994 to Archer discloses a complex method of adjusting a rotatable lamp having wiring extending through a hollow bushing U.S. Pat. No. 4,722,502 to Mueller et al. discloses a dual armed support having one connector with an adjustable fastener with the opposed connector being hollow to transport the electrical wiring to the lamp.

SUMMARY OF THE INVENTION

Accordingly, an object of the present invention is to provide a rotatable joint that protects the wiring from damage.

Another object of the present invention is to provide an adjustable mounting assembly for a lighting fixture that is easy to adjust by exteriorly accessible fasteners.

Another object of the present invention is to provide an adjustable mounting assembly that has a strong, weatherproof rotatable joint.

Another object of the present invention is to provide an adjustable mounting assembly capable of being vertically or horizontally mounted.

A further object of the present invention is to provide an adjustable mounting assembly that is easy to rotate and safe to use.

The foregoing objects are basically attained by an adjustable mounting assembly for a lighting fixture, comprising at least one supporting member with wiring extending through the support member for electrically coupling the fixture to a power source. At least one casing having a fastener sleeve and having at least one conduit receiving the support member and the wiring is provided. The casing is rotatable with respect to the fixture. A spacer for spacing the casing from the fixture is provided which has a bore and an aperture receiving the wiring. A fastener extending through the fastener sleeve and the bore adjustably and rotatably couples the casing and the spacer to the fixture and releasably retains the fixture in selected rotational positions relative to the casing and support member. The fastener is independent from the casing.

Other objects, advantages and salient features of the invention will become apparent from the following detailed description, which, taken in conjunction with the annexed drawings, discloses preferred embodiments of the invention.

As used in this application, the terms "upper", "lower", "outside", "underside", "bottom", "side", "above", "beneath", "below" and "upstanding" are intended to facilitate the description of the mounting assembly. Thus, such terms are merely illustrative of the mounting assembly and not intended to limit the mounting assembly to any specific orientation.

BRIEF DESCRIPTION OF THE DRAWINGS

Referring to the drawings which form a part of this disclosure:

FIG. 3*a* is a side elevational view of the casing of the mounting assembly according to the first embodiment of the present invention;

FIG. 3*b* is a side elevational view of the spacer of the mounting assembly according to the first embodiment of the present invention;

FIG. 3*c* is a side elevational view of the lighting fixture of the present invention in the horizontal position;

FIG. 3*d* is a side elevational view of the lighting fixture of the present invention in the vertical position;

DETAILED DESCRIPTION OF THE INVENTION

Figure 1:
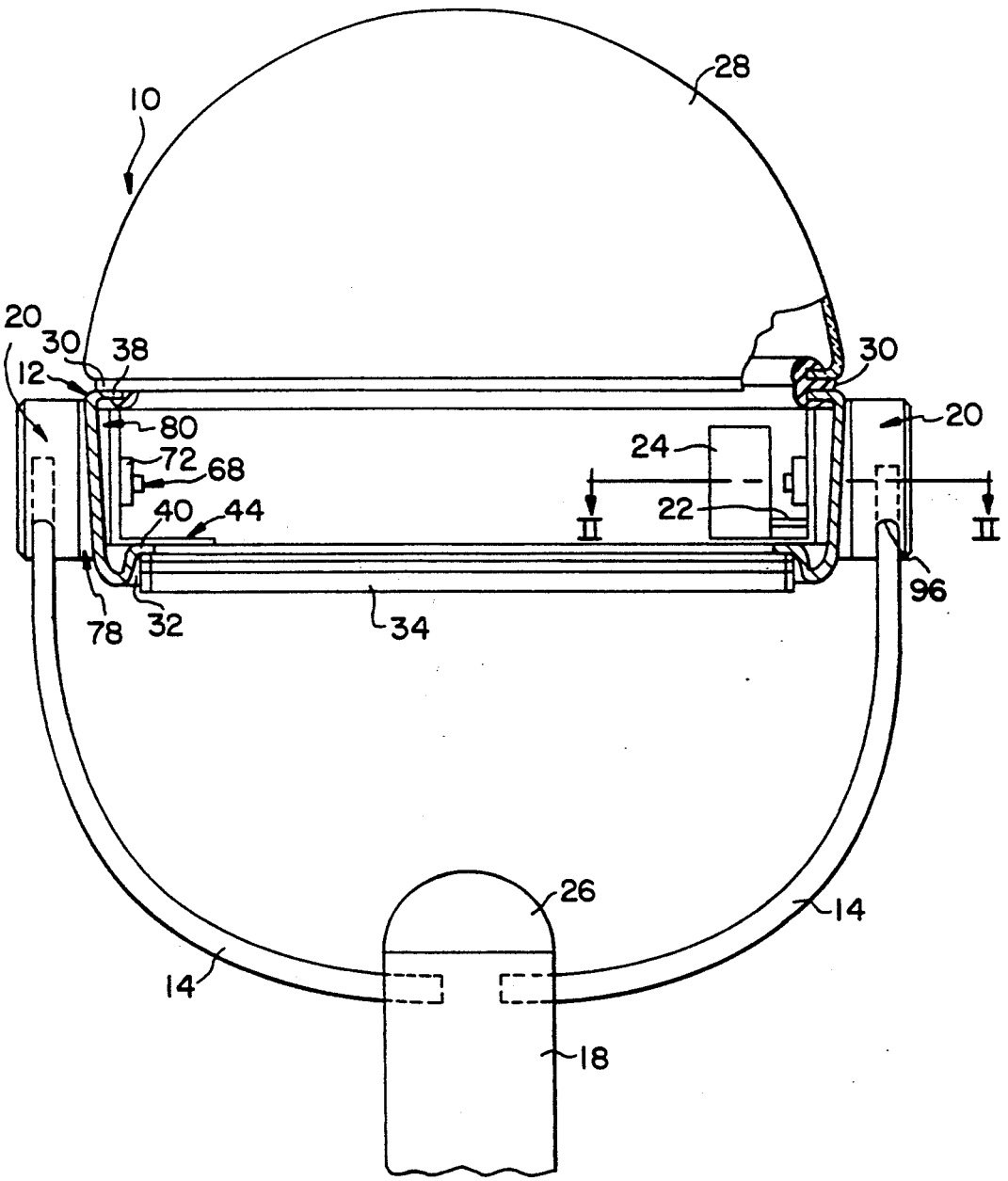
FIG. 1 is a front elevational view of the lighting fixture in partial section in accordance with the first embodiment of the present invention.
Figure 2:
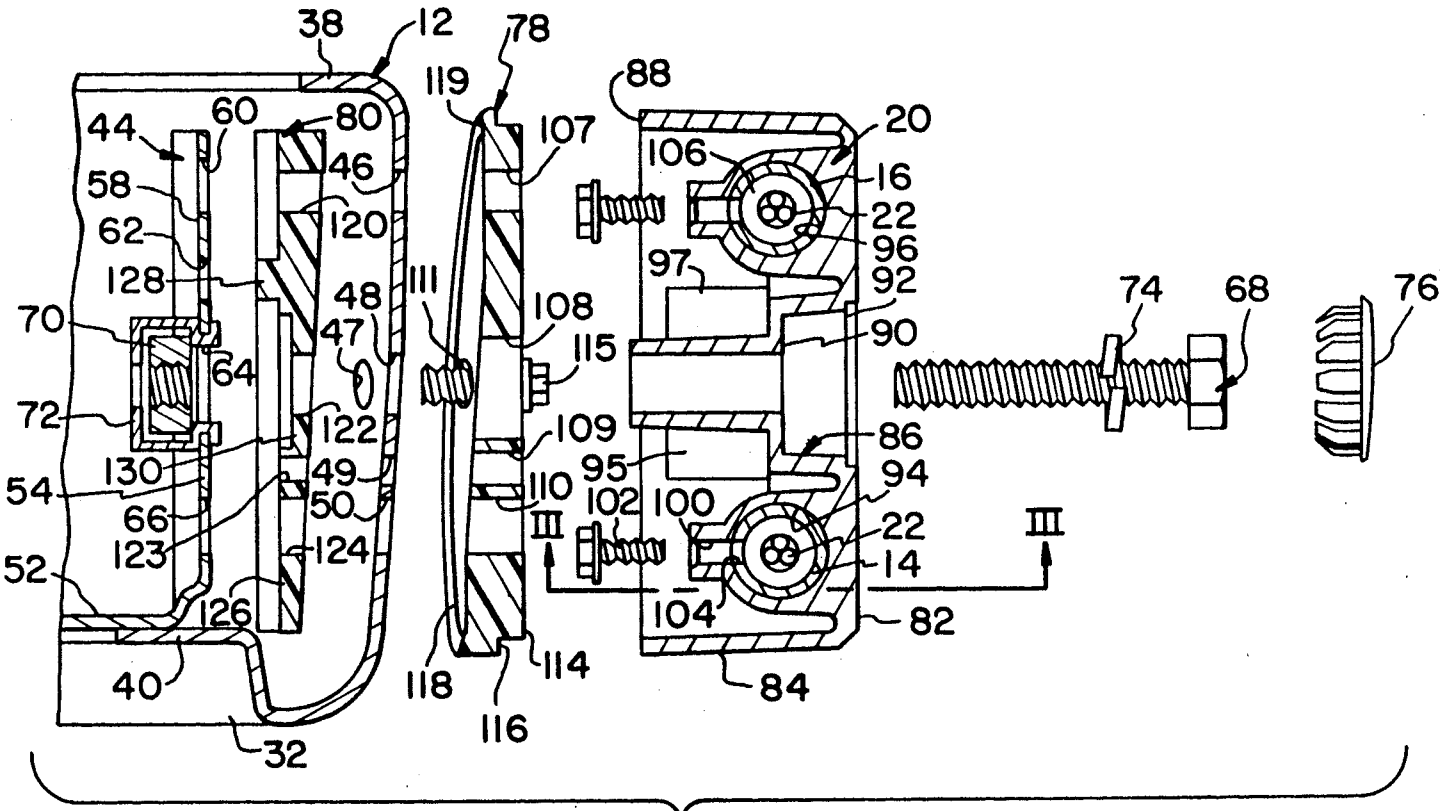
FIG. 2 is an exploded, enlarged, side elevational view in cross section of the mounting assembly of the lighting fixture of FIG. 1.
Figure 2A:
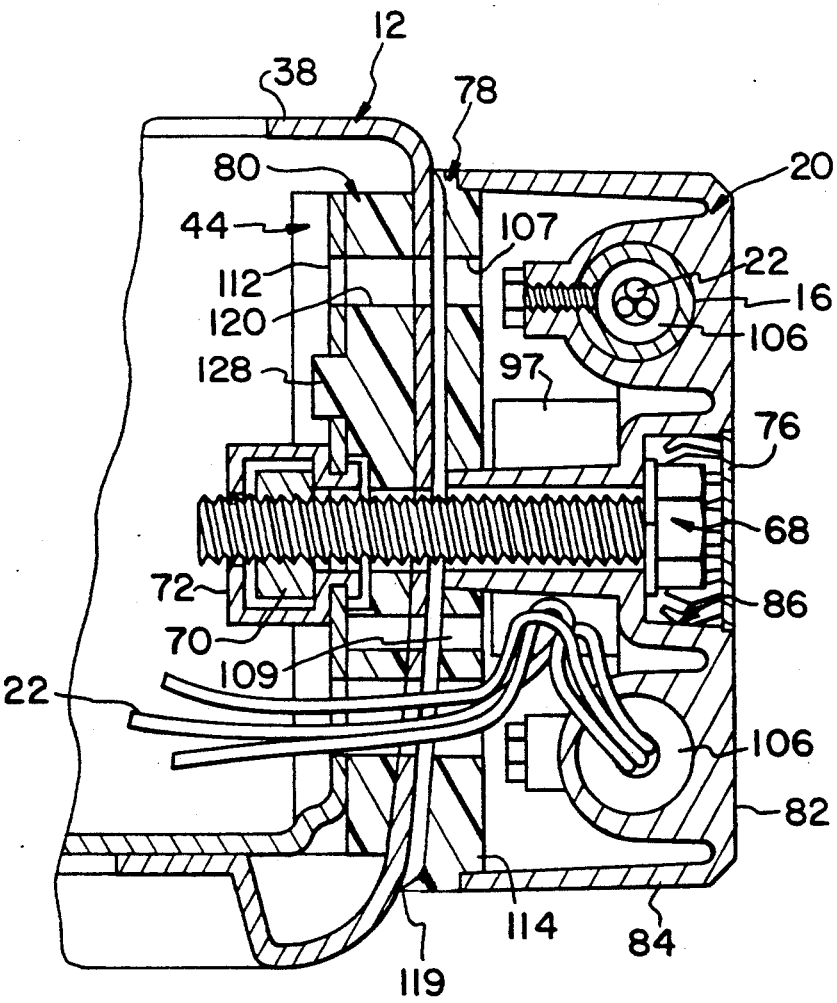
FIG. 2*a* is a front elevational view in cross section of the assembled mounting assembly of FIG. 2.

Referring initially to FIGS. 1, 2, and 2*a*, an adjustable mounting assembly for a lighting fixture 10 is illustrated in accordance with the present invention and includes fixture housing 12 carried by a pair of identical support members 14 and 16 on each side. A pole or slip fitter 18 supports the entire assembly as shown in FIG. 1. Ear muffs or casings 20 secure support members 14 and 16 to fixture housing 12. Electrical wiring 22 is contained within pole 18 and extends through support member 14 and/or support member 16 into fixture housing 12 to power panel 24, schematically represented in FIG. 1.

Pole 18 is a typical tubular support preferably made of metal and terminated with thematic cap 26 to prevent water and debris from entering the pole and damaging the wiring. Support members 14 and 16 are cantilever spokes also formed of tubular metal arranged in opposed pairs, the front member 14 of each pair being shown in FIG. 1.

Figure 4:
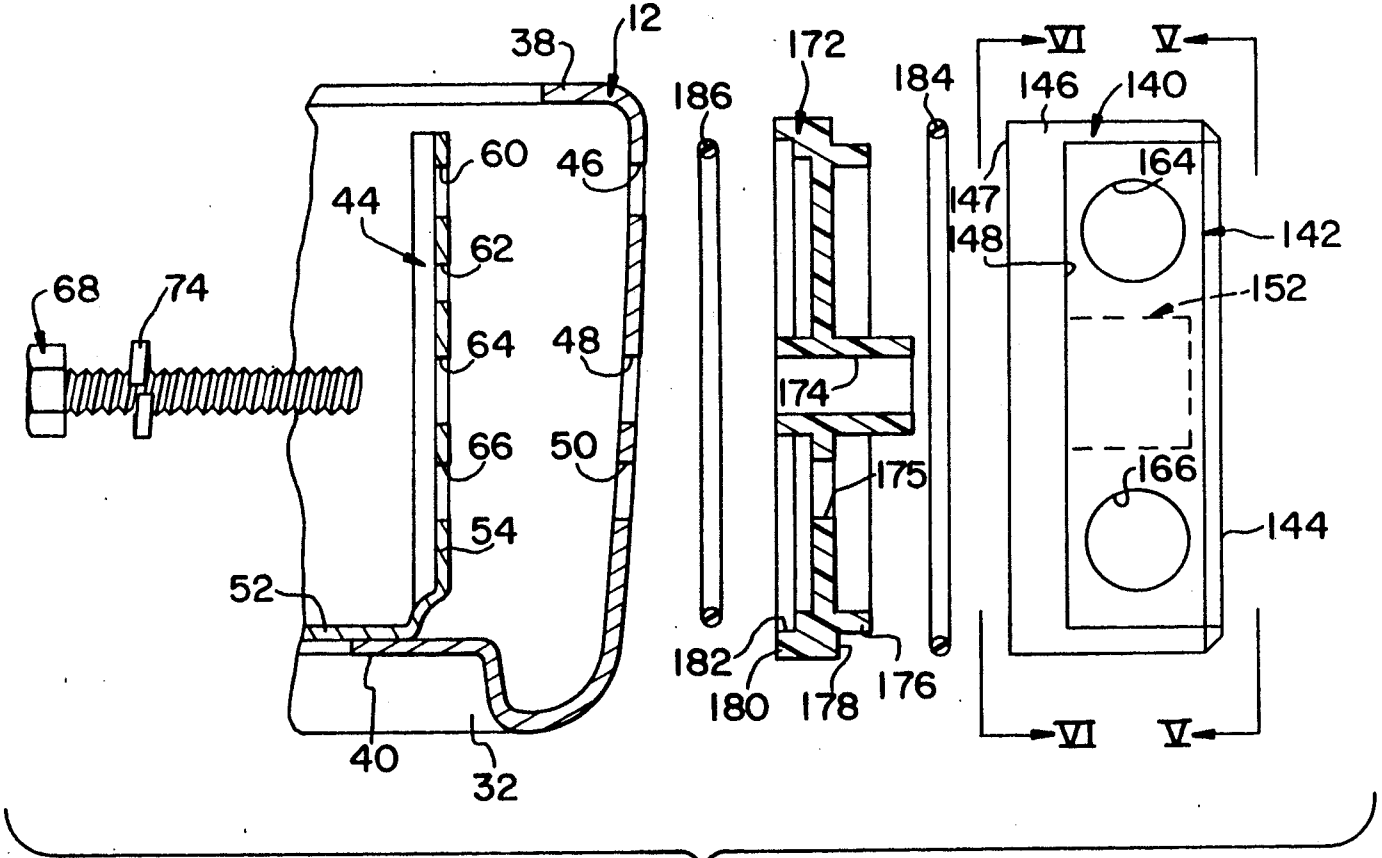
FIG. 4 is an exploded, enlarged side elevational view in cross section of a mounting assembly in accordance with a second embodiment of the present invention.

Fixture housing 12 is a ring shaped or annular member supporting the lighting dome 28 formed as a spun aluminum or acrylic glow top. Lighting dome 28 is coupled to fixture housing 12 by a sealing ring assembly comprising a clamping gasket 30 as shown in FIG. 1. Alternatively, lighting dome 28 can be mounted to fixture housing 12 by a spring clip and separate sealing spacer. Housing 12 has an upper flange 38 upon which dome 28 is seated, and a lower flange 40 having apertures 42 for securing housing 12 to housing support bracket 44. Housing 12 also has sets of at least four vertically aligned apertures 46, 48, 49 and 50 and a pair of horizontally aligned apertures, one on each side of and laterally spaced from the vertical apertures, one of the apertures 47 being shown in FIG. 2, on opposed sides of the housing outside wall. One side of housing 12 is shown in FIGS. 2 and 4. The other side is the mirror image of the illustrated side. The underside of fixture housing 12 has a recessed portion 32 for receiving a lens and reflector assembly 34 shown schematically. Housing 12 is preferably made of metal.

Housing support bracket 44 is an L-shaped bracket preferably made of sheet metal having a wide base 52 tapering to upstanding leg 54. Base 52 has a plurality of apertures 56 which align with apertures 42 in housing 12 for securement by conventional fasteners. Upstanding leg 54 has a central groove 58 with a plurality of vertically aligned apertures 60, 62, 64 and 66. Apertures 60, 64 and 66 in housing support bracket 44 align with apertures 46, 48 and 50 in fixture housing 12 as shown in FIGS. 2 and 4.

As described below, fastener 68, preferably a threaded bolt, secures casing 20 to fixture housing 12 and housing support bracket 44 through apertures 48 and 64. Nut 70 is held in place against housing support bracket 44 by nut retainer 72 which snap fits within aperture 64. A lock washer 74 is used to hold fastener 68 securely in place. Hole plug 76 has resilient fingers which snap into casing 20 as discussed below for concealing fastener 68 and weatherproofing the assembly 10.

ONE PIECE CASING

The mounting assembly shown in FIGS. 1-3 and 3*a* includes a one piece ear muff or casing 20, a casing spacer 78 and a housing support spacer 80 secured to fixture housing 12 and housing support bracket 44 by fastener 68.

Casing 20 is a cylindrical hollow cup shaped member preferably formed of cast metal or molded plastic with a bottom 82 and a tubular side wall 84. A fastener sleeve or throughbore 86 extends through the bottom 82, coaxially to sidewall 84. Throughbore 86 is a cylindrical tubular passage which protrudes beyond the upper or free end edge 88 of tubular side wall 84. A recessed shoulder 90 provides a seat for the head of fastener 68. Similarly, annular groove 92 provides a seat for hole plug 76 when hole plug 76 is snapped into throughbore 86. As seen in FIG. 2, recessed shoulder 90 is sufficiently wide to allow clearance around the head of fastener 68 for insertion of a tool to rotate fastener 68.

Figure 3:
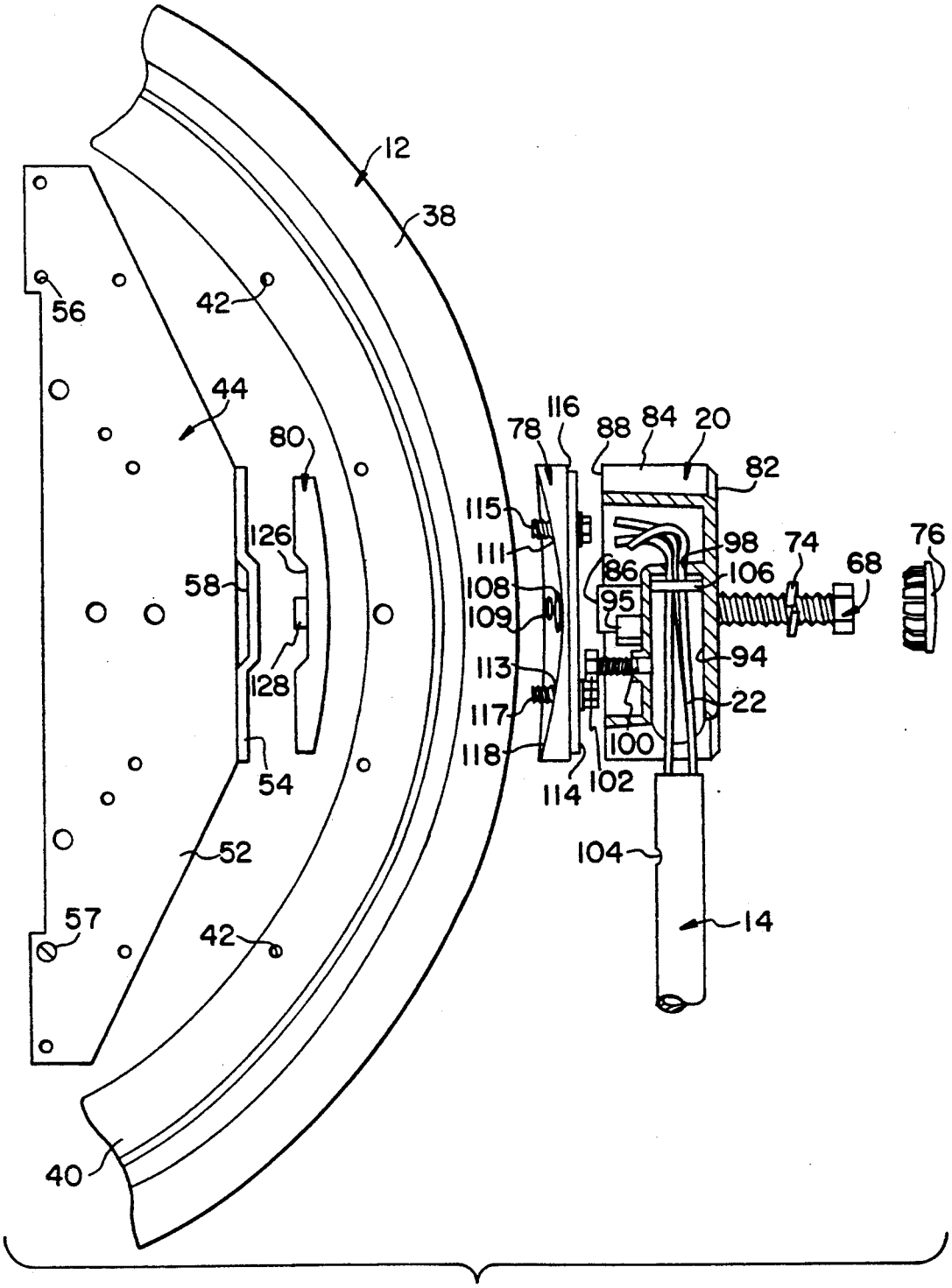
FIG. 3 is a plan view in partial section of the mounting assembly of FIG. 2 in a horizontally mounted position.

Extending through sidewall 84, transversely to throughbore 86, are tubular conduits 94 and 96. Each conduit is the same. As shown in FIG. 3, conduit 94 terminates in aperture 98 providing communication between the conduit and the hollow central portion of casing 20. Each conduit has an aperture 100 in the sidewall for securing a support tube in the respective conduit. Set screws 102 received in apertures 100 engage a fastening aperture 104 in each support member.

A watertight gasket 106 is located within each conduit and receives wiring 22 to be fed through aperture 98. As seen in FIG. 3, when assembled, support member 14 abuts gasket 106 within conduit 94 and prevents water from passing into casing 20.

A pair of radially extending stop ribs 95 and 97 protrude from throughbore 86 generally toward conduits 94 and 96 as seen in FIGS. 2, 2*a* and 3. Ribs 95 and 97 radiate outwardly from throughbore 86 with a relative angular spacing of about 130 degrees from each other. Ribs 95 and 97 are molded integrally with casing 20.

Casing spacer 78 is a polymeric disk having a hole or bore 108. Bore 108 is sized to receive tubular throughbore 86 of casing 20. Directly above and beneath bore 108 are fastening apertures 107 and 109, respectively. Beneath bore 109 is wiring aperture 110 located to accommodate wiring 22.

Extending around the outer edge of spacer 78 is annular shoulder 116. Side 114 is sized to fit rotatably within hollow casing 20 with upper edge 88 of sidewall 84 of casing 20 abutting annular shoulder 116. The opposite side 118 of spacer 78 is generally concave, best seen in FIG. 3, to conform to the shape of housing 12. The bottom of side 118 is spaced farther from shoulder 116 than the top of side 118, as seen in FIG. 2. A bead 119 extends axially outward from the outside edge of side 118. Side 118 and bead 119 conform closely to the shape of the exterior of housing 12 so that spacer 78 does not rotate or form a gap when abutting housing 12. When assembled, fastening apertures 107 and 109 align with apertures 46 and 49, respectively, in housing 12. Bore 108 aligns with aperture 48, and aperture 110 aligns with aperture 50 to allow passage of fastener 68 and wiring 22, respectively.

Housing support spacer 80 is located within housing 12 between housing support bracket 44 and housing 12. Housing support spacer 80 also has four vertically aligned apertures 120, 122, 123 and 124. A pair of horizontally aligned apertures 111 and 113 are disposed on each side of bore 108 as seen in FIGS. 3 and 3*b*. Vertical apertures 120 and 123 align with apertures 46 and 49 in housing 12 and apertures 107 and 109 in spacer 78, respectively. Horizontal apertures 111 and 113 align with the pair of horizontal housing apertures, aperture 47 being shown in FIG. 2. Aperture 122 receives fastener 68 and therefore aligns with aperture 48 in housing 12, aperture 108 in spacer 78, and aperture 64 in housing support bracket 44. Aperture 124 aligns with aperture 50 in housing 12, aperture 110 in spacer 78 and aperture 66 in housing support bracket 44 for passage of wires 22. The outer wall of housing support spacer 80 is slightly convex as shown in FIG. 3. The inner wall has a central vertical channel 126 with a locating protuberance 128 therein. Locating protuberance 128 is shaped to fit snugly within aperture 62 of housing support bracket 44. Also within channel 126 is depression 130 for accommodating the clamping flanges of nut retainer 72 in housing support bracket 44. Housing support spacer 80 is also made of polymeric material for a snug fit between housing support bracket 44 and housing 12.

ASSEMBLY OF ONE PIECE CASING

Beginning inside housing 12 as seen in FIGS. 2 and *2a*, nut retainer 72 with nut 70 therein is snap fit into aperture 64 of housing support bracket 44. Housing support spacer 80 is clamped between housing support bracket 44 and housing 12 such that locating protuberance 128 is frictionally held within aperture 62 of housing support bracket 44. Apertures 60, 120 and 46 are in alignment; apertures 64, 122 and 48 are in alignment; apertures 123 and 49 are in alignment; and apertures 66, 124 and 50 are in alignment. As shown in FIG. 3, center groove 58 in housing support bracket 44 mates with channel 126 of housing support spacer 80 for a snug engagement. Housing support bracket 44 is secured to housing 12 by conventional fasteners 57 engaging apertures 56 and 42. The outside convex surface of housing support spacer 80 abuts the inside of housing 12.

Casing spacer 78 fits flushly against the outer wall of housing 12. Vertical fastening apertures 107 and 109 are aligned with apertures 46 and 49 in housing 12. Similarly, horizontal fastening apertures 111 and 113 align with the pair of horizontal apertures 47 in housing 12. Bore 108 aligns with aperture 48 in housing 12, aperture 122 in housing support spacer 80, and aperture 64 in housing support bracket 44. Wiring aperture 110 aligns with aperture 50 in housing 12, aperture 124 in housing support spacer 80 and aperture 66 in housing support bracket 44.

To mount the assembly horizontally, as shown in FIGS. 3 and *3c*, fasteners 115 and 117 are placed in apertures 111 and 113 of spacer 78 and secured to housing 12. Alternatively, the assembly can be mounted vertically (FIG. *3d*) by placing fasteners in apertures 107 and 109 to be secured to housing 12.

Wiring from conduits 14 and/or 16 is threaded through gasket 106 and aperture 98 into casing 20 and through apertures 110, 50, 124 and 66 to power panel 24. Support members 14 and 16 are inserted into conduits 94 and 96 abutting gasket 106 and secured therein by set screws 102 received in apertures 100 and 104. Casing 20 then fits over axial flange 114 and abuts annular shoulder 116 in rotatable engagement. Throughbore 86 extends into bore 108 in casing spacer 78 in sealing engagement. Fastener 68 with lock washer 74 is inserted into throughbore 86, bore 108, aperture 48, aperture 122, and aperture 64 to be received in nut 70, and then protrudes outwardly from nut retainer 72 as seen in FIG. 1. Hole plug 76 is snapped into throughbore 86 and fits flushly within casing 20 in groove 92.

Thus, housing support bracket 44, housing support spacer 80, housing 12 and casing spacer 78 are secured in nonrotatable engagement. In distinction, casing 20 is rotatably secured to housing 12 via fastener 68 and rotates about axial flange 114. Wiring 22 is installed with sufficient slack within hollow casing 20 to allow casing 20 to rotate with respect to casing spacer 78 without interfering with the passage of wiring 22 through wiring aperture 110. Throughbore 86 entirely shields wiring 22 from fastener 68.

In the horizontally mounted position shown in FIG. 3, fasteners 115 and 117 interfere with set screws 102 during rotation, the set screws thus acting as rotational stops. Casing 20 is limited to a rotation of about 45 degrees up and about 45 degrees down. In the vertically mounted position, stop ribs 95 and 97 interfere with the head of the fastener received in aperture 109 in spacer 78 as can be envisioned in FIG. *2a*. In the vertical mount, the head of the fastener would travel between stop ribs 95 and 97.

To adjust the assembly 10, plug caps 76 are removed and fasteners 68 are loosened on each side of housing 12 with an appropriate tool from the exterior of the casings. The assembly 10 can then be rotated to the desired position. To secure the lamp in a selected position, fasteners 68 on each side are tightened and plug caps 76 are replaced.

Casing spacer 78 provides a waterproof seal against housing 12 so that the lamp fixture is weatherproof. Additionally, hole plug 76 prevents water from entering throughbore 86 and travelling into fixture housing 12.

CASING WITH REMOVABLE PORTION

Figure 5:
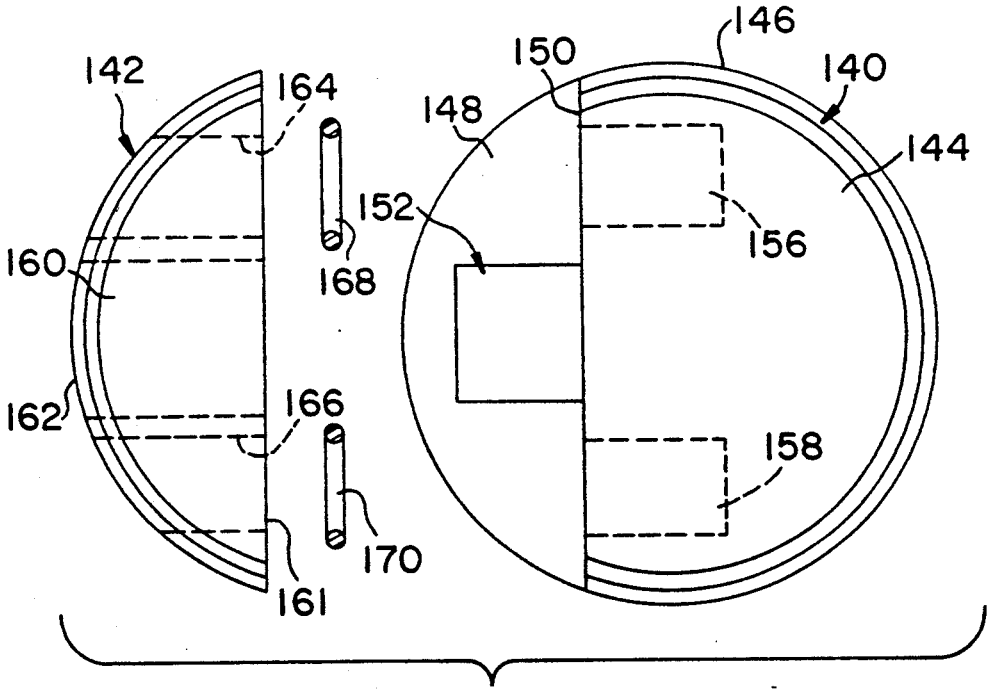
FIG. 5 is an enlarged, exploded front elevational view of the casing of FIG. 4.
Figure 6:
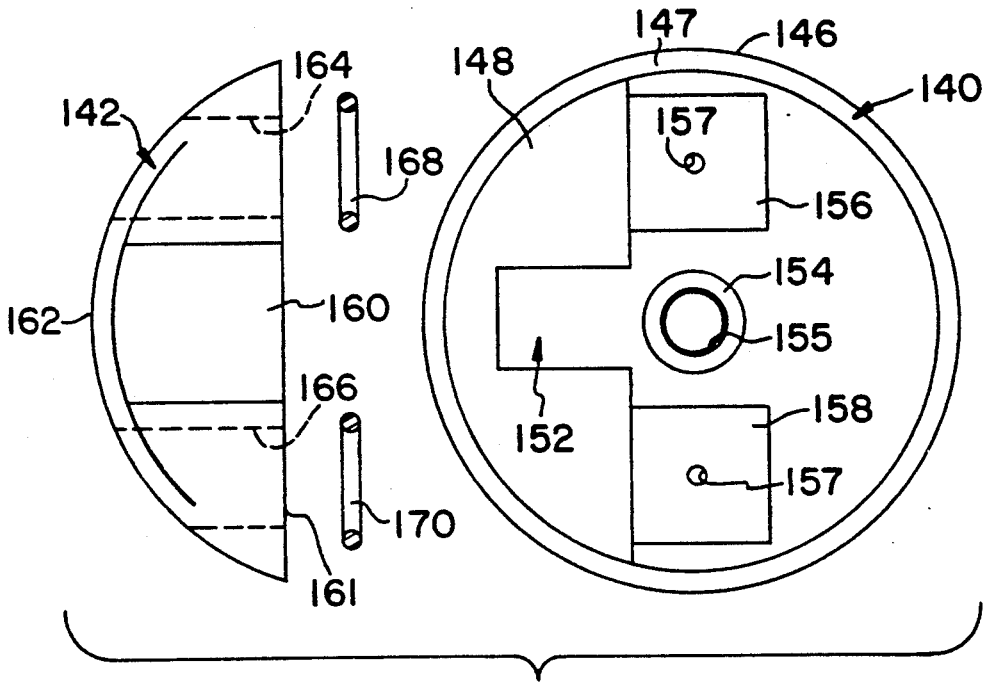
FIG. 6 is an enlarged, exploded back elevational view of the casing of FIGS. 4 and 5.

The mounting assembly shown in FIGS. 4 through 6 utilizes the same fixture housing 12, housing support bracket 44 and fastener 68 as disclosed in FIGS. 1 through 3. In this embodiment, casing 140 has a removable portion 142. Casing 140 is a generally cylindrical hollow cup with a bottom 144 and a cylindrical side wall 146 with upper or free end edge 147. A portion of the bottom 144 and side 146 is cut away leaving a flat shelf 148 and upstanding wall 150. A generally rectangular prism shaped hollow leg 152 extends from upstanding wall 150 across shelf 148.

Casing 140 has a fastening sleeve or central tube 154 with internal threads 155 extending from bottom 144 and partially into the hollow center, coaxial with cylindrical sidewall 146. On both sides of tube 154 are tubular conduits 156 and 158 extending from upstanding wall 150 into the hollow chamber of casing 140. Within the hollow center of casing 140, as seen in FIG. 6, is the underside of shelf 148 and the inside of hollow rectangular prism shaped leg 152. Conduits 156 and 158 have an end aperture for receiving wiring 22 similar to aperture 98 as discussed with respect to casing 20. Aperture 157 in each conduit receives a set screw for retaining support members 14 and 16.

Removable portion 142 is complementarily shaped with casing 140 to form a flush cylindrical cup. Removable portion 142 has a bottom 160 which is partially circular in shape with an inner straight edge 161 and an outer arcuate sidewall 162. A pair of generally parallel passages 164 and 166 extend through sidewall 162 and terminate flushly with the inner straight edge 161 of bottom 160. Passage 164 is axially aligned with conduit 156, and passage 166 is axially aligned with conduit 158. When assembled, leg 152 fits snugly between the tubular walls of passages 164 and 166.

As seen in FIGS. 5 and 6, watertight gaskets or O-rings 168 and 170 are located between passage 164 and conduit 156 and passage 166 and conduit 158, respectively, to insure a waterproof connection between removable portion 142 and casing 140.

Located between housing 12 and casing 140 is sealing spacer 172 illustrated in FIG. 4. Spacer 172 has a central cylinder or bore 174 aligned with tube 154 of casing 140, aperture 48 of housing 12, aperture 64 of housing support bracket 44, and nut 70. Cylinder or bore 174 of spacer 172 extends into casing 140 to abut throughbore 154. Below bore 174 is wiring aperture 175 which aligns with aperture 50 in housing 12 and aperture 66 in housing support bracket 44. Similar to casing spacer 78, spacer 172 has an axial flange 176 extending from one side and spaced from the edge by annular shoulder 178. Axial flange 176 is sized to fit within casing 140, and annular shoulder 178 provides a stop surface for upper edge 147 of casing 140. Extending from annular shoulder 178 is axial ring 180. Within ring 180 is sealing groove 182 extending completely around the inside of axial ring 180.

Located between annular shoulder 178 and upper edge 147 is an annular gasket 184 to ensure a watertight seal between casing 140 and sealing spacer 172. Axial flange 176 is sufficiently long to rotatably engage casing 140 with gasket 184 in place. Gasket 186 sits in sealing groove 182 to ensure a fluid-tight seal between sealing spacer 172 and housing 12. Gaskets 184 and 186 are made of polymeric material. Sealing spacer 172 is also made of polymeric material and is nonrotatably coupled to housing 12 via fastener 68 due to its sealing ability against the side edge of housing 12.

ASSEMBLY OF CASING WITH REMOVABLE PORTION

Housing support bracket 44 is secured to housing 12 as described with reference to FIG. 3 via apertures 56 and 42 and conventional fasteners 57. Gasket 186 is placed within sealing spacer 172 and gasket 184 is placed around axial flange 176 of sealing spacer 172.

Wiring 22 from support members 14 and 16 are fed through passages 164 and 166, through O-rings 168 and 170, into conduits 156 and 158 and through the end apertures in the conduits into casing 140. Support members 14 and 16 are inserted into passages 164 and 166, within gaskets 168 and 170, and into conduits 156 and 158, respectively. Support members 14 and 16 are retained within conduits 156 and 158 by set screws in apertures 157 as discussed with respect to the securement method shown in FIG. 2.

Removable portion 142 of casing 140 is slid over leg 152 and to abut upstanding wall 150 and shelf 148 of casing 140. Removable portion 142 is held in place by conventional fastener with leg 152. Casing 140, with removable portion 142 in place, is then placed over axial flange 176 of sealing spacer 172 and fastened to housing 12 and housing support bracket 44 by fastener 68. Fastener 68 with locking washer 74 in place is passed through aperture 64, aperture 48, bore 174 and into tube 154. Fastener 68 is rotatably engaged with threads 155 in tube 154.

Once assembled, moisture is prevented from entering casing 140 by gaskets 168 and 170 around support members 14 and 16 and hole plug 76. Sealing spacer 172 seals moisture from housing 12 and casing 140 with gaskets 184 and 186. Wiring 22 is protected from fastener 68 by tube 154 and bore 174.

Alternatively, tube 154 may be formed as a through bore similar to throughbore 86 of FIGS. 1-3. Similarly, tube or throughbore 86 of casing 20 shown in FIGS. 1-3 may be threaded to receive fastener 68 from within housing 12.

While various embodiments have been chosen to illustrate the invention, it will be understood by those skilled in the art that various changes and modifications can be made therein without departing from the scope of the invention as defined in the appended claims.

What is claimed is:

1. An adjustable mounting assembly for a lighting fixture, comprising:

at least one support member;

wiring means extending through said support member for electrically coupling the fixture to a power source;

at least one casing having a fastening sleeve and having at least one conduit receiving said support member and said wiring means, said casing being rotatable with respect to the fixture;

spacer means for spacing said casing from the fixture, said spacer means having a bore and having an aperture receiving said wiring means; and fastener means, extending through said fastening sleeve and said bore, for adjustably and rotatably coupling said casing and said spacer means to the fixture and releasably retaining the fixture in selected rotational positions relative to said casing and support member, said fastener means being independent from said casing.

2. An adjustable mounting assembly according to claim 1, wherein said casing is a hollow cup having a bottom and a tubular side wall; and said fastening sleeve extends through said bottom coaxially to said side wall, and said conduit extends through said side wall transversely to said fastening sleeve.

3. An adjustable mounting assembly according to claim 1, wherein said conduit includes securement means for retaining said support member in said conduit.

4. An adjustable mounting assembly according to claim 3, wherein said securement means includes an aperture in said conduit and a set screw received in said aperture.

5. An adjustable mounting assembly according to claim 1, wherein said spacer means includes means for non-rotatably coupling said spacer means to the fixture and for rotatably coupling said spacer means to said casing.

6. An adjustable mounting assembly according to claim 1, wherein said spacer means is polymeric and forms a fluid-tight seal with the fixture.

7. An adjustable mounting assembly according to claim 1, wherein said spacer means is a disk having an annular shoulder spaced from one side thereof.

8. An adjustable mounting assembly according to claim 7, wherein said disk is generally concave on another side.

9. An adjustable mounting assembly according to claim 1, wherein said spacer means is a disk having a generally concave side.

10. An adjustable mounting assembly according to claim 1, wherein said fastening sleeve is a threaded tube.

11. An adjustable mounting assembly according to claim 1, wherein an interior spacer member, positionable within the fixture, comprises a bore receiving said fastener means, an aperture receiving said wiring means.

12. An adjustable mounting assembly according to claim 11, wherein said interior spacer member has a locating protuberance.

13. An adjustable mounting assembly according to claim 11, wherein said interior spacer member is polymeric.

14. An adjustable mounting assembly according to claim 1, wherein a gasket is located within said conduit providing a fluid-tight seal between said wiring means and said casing.

15. An adjustable mounting assembly according to claim 1, wherein said casing has two generally parallel conduits.

16. An adjustable mounting assembly according to claim 1, wherein at least one sealing ring abuts said spacer means.

17. An adjustable mounting assembly according to claim 1, wherein said casing has a removable portion, said portion has a passage axially aligned with said conduit for receiving said support member.

18. An adjustable mounting assembly according to claim 17, wherein said passage has a fluid-tight seal with said conduit.

19. An adjustable mounting assembly according to claim 17, wherein said casing is a cylindrical cup and said removable portion is partially cylindrical with a curved outer wall and a generally planar inner wall.

20. An adjustable mounting assembly according to claim 17, wherein said removable portion has a pair of generally parallel passages.

21. An adjustable mounting assembly according to claim 1, wherein said spacer means has a plurality of apertures for receiving threaded fasteners.

22. An adjustable mounting assembly according to claim 1, wherein said casing has a pair of stop ribs extending radially outwardly from said fastening sleeve.

23. An adjustable mounting assembly according to claim 22, wherein said stop ribs are spaced about 130° from each other.

24. An adjustable lighting fixture, comprising:

a fixture housing;

a pair of cantilever support members;

wiring means extending through at least one of said support members for electrically coupling said fixture to a power source;

a pair of casings, each having a fastening sleeve and having at least one conduit receiving one of said support members, said conduit in one of said casings receiving said wiring means, each of said casings being rotatable with respect to said housing;

a pair of casing spacer means for spacing said casings from said housing, each of said casing spacer means having a bore and having an aperture, said aperture in one of said casing spacer means receiving said wiring means; and a pair of fastener means, extending into said fastening sleeves and said bores, for adjustably and rotatably coupling each of said casings to one of said casing spacer means and to said housing and releasably retaining said housing in selected rotational positions relative to said casings and support members, each of said fastener means being independent from the respective casing.

25. An adjustable lighting fixture according to claim 24, wherein each of said casings is a hollow cup with an upper edge; and each of said casing spacer means is a disk with an annular shoulder spaced from one side, said shoulders being rotatably engaged with said upper edges of said cups, said sides extending into said cups for axial alignment.

26. An adjustable lighting fixture according to claim 24, wherein a pair of housing spacer means are coupled to said fastener means in axial alignment with said casings and said casing spacer means; and said housing being coupled between said housing spacer means and said casing spacer means.

27. An adjustable lighting fixture according to claim 24, wherein a pair of support brackets are coupled to said fastener means; and said housing is coupled between said brackets and said casings.

28. An adjustable lighting fixture according to claim 24, wherein each one of said casings has a removable portion with at least one passage aligned with said conduit therein.

29. An adjustable lighting fixture according to claim 28, wherein sealing means is located between said passage and said conduit in each said casing.

* * * * *